US005495216A

United States Patent [19]

Jachowski

[11] Patent Number: 5,495,216

[45] Date of Patent: Feb. 27, 1996

[54] APPARATUS FOR PROVIDING DESIRED COUPLING IN DUAL-MODE DIELECTRIC RESONATOR FILTERS

[75] Inventor: Douglas Jachowski, Reno, Nev.

[73] Assignee: Allen Telecom Group, Inc., Solon, Ohio

[21] Appl. No.: 227,739

[22] Filed: Apr. 14, 1994

[51] Int. Cl.[6] ..... H01P 1/20

[52] U.S. Cl. ..... 333/208; 333/212; 333/230

[58] Field of Search ..... 333/202, 219.1, 333/208–212, 230

[56] References Cited

U.S. PATENT DOCUMENTS

| | | | |
|---|---|---|---|
| 4,251,787 | 2/1981 | Young et al. | 333/212 X |
| 4,489,293 | 12/1984 | Fiedziuszko | 333/202 |
| 4,652,843 | 3/1987 | Tang et al. | 333/212 |
| 5,070,313 | 12/1991 | Gladh et al. | 333/219.1 X |
| 5,083,102 | 1/1992 | Zaki | 333/212 |
| 5,258,659 | 12/1993 | Zaki et al. | 333/212 X |

FOREIGN PATENT DOCUMENTS

| | | | |
|---|---|---|---|
| 1483521 | 5/1989 | U.S.S.R. | 333/212 |

OTHER PUBLICATIONS

S. J. Fiedziuszko, "Dual–Mode Dielectric Resonator Loaded Cavity Filters", IEEE Transactions on Microwave Theory and Techniques vol. MTT–309, No. 9, Sep.1982, pp. 1311–1316.

Chandra Kudsia, "Innovations in Microwave Filters and Multiplexing Networks for Communication Satellite Systems," IEEE Transactions on Microwave Theory and Techniques, vol. MTT–40, No. 6, Jun. 1992, pp. 1133, 1140–1141 and 1148.

*Primary Examiner*—Robert J. Pascal
*Assistant Examiner*—Darius Gambino
*Attorney, Agent, or Firm*—Laff, Whitesel, Conte & Saret, Ltd.

[57] ABSTRACT

A dual-mode dielectric-resonator-loaded cavity filter comprises a generally cylindrical cavity, at least two longitudinally-spaced dielectric resonator elements coaxially aligned within the cavity, and at least one coupling obstacle disposed between the resonators and extending a distance from the cavity wall. The coupling obstacles are preferably conductive and are electrically connected to the cavity wall. However, the obstacles may be constructed of a dielectric material in some applications. Each obstacle may be aligned with one of the reference planes corresponding to a resonant mode of the resonators to effectively control or reduce the coupling between the parallel resonant modes of adjacent resonators. The reduction in coupling between resonant modes of adjacent resonators allows large coupling differentials to be produced, allowing a filter designer to implement a wide variety of high-performance filters without expensive irises. The coupling obstacle achieves the reduction in coupling without requiring large spacing between adjacent resonators. The coupling obstacles may be conveniently and inexpensively produced in bar, wire, hemi-disk, and other configurations. Several adjustments allow the resonators to be tuned, and the couplings to be adjusted, after the filter is assembled, reducing the complexity and expense of manufacture. In particular, the coupling obstacles arc mounted for limited translation along the longitudinal axis of the cavity, and for rotation about their own longitudinal axes, thereby adjusting the amount of coupling reduction they provide.

17 Claims, 12 Drawing Sheets

Z
Y
X
116
194
164
162
8
166
174
140
178
136
7
158
134
160
152
154
156
6
148
168
138
150
5
118
142
130
170
146
4
192
144
100
196
120

Z
Y
X
162
198
194
136
166
172
140
174
158
160
152
154
134
156
138
148
150
118
176
168
142
130
144
192
100

APPARATUS FOR PROVIDING DESIRED COUPLING IN DUAL-MODE DIELECTRIC RESONATOR FILTERS

BACKGROUND OF THE INVENTION

This application relates to radio-frequency filters employed in communications systems, and more particularly to filters of the dual-mode, multiple-resonating-element type employed in communications systems operating at Ultra High Frequencies (UHF) and above.

Modern communications systems typically employ high-performance filters in antenna circuits and in other system components. Although communications systems which require such filters have been known for many years, a majority of such systems have heretofore been developed for use principally in military and aerospace applications, in which extremely high development and manufacturing costs have been acceptable in order to obtain high performance.

In recent years, however, several radio-based communications systems operating in the UHF frequency range and above have been developed for use primarily by commercial enterprises and individuals. A prime example of such systems is the cellular telephone network, which has enjoyed wide acceptance among commercial and individual subscribers. Such subscribers are generally more sensitive to costs than are military and aerospace users, and therefore, so are those who develop and operate such systems. Although the use of very-high-performance filters in lower-cost communications systems would be technically desirable, cost constraints have generally resulted in a tradeoff between filter performance and cost.

Broadly considered, "performance" encompasses a variety of preferred filter characteristics. In many cost-constrained systems, filter size is the aspect of performance which is sacrificed for cost. In the initial applications of modern communications systems, filter size may not have been critical, because usage levels were low and therefore did not require components to be densely implemented. However, as usage grew, the density of individual components had to increase to provide the desired coverage.

For example, in the early cellular telephone, systems, a relatively small number of fixed or base stations were provided, each having only a few channels, and such stations were generally installed in facilities at which space was not at a premium. However, as usage of cellular telephone systems has increased, the nature of base stations has changed. Individual base stations are now often provided with a larger number of channels than in the past. In addition, a substantially greater number of base stations may be provided. Because increased system density generally requires geographically smaller cells, the availability of suitable sites within each cell is limited, and many base stations must be located in facilities where space is at a premium. Thus, both of these changes in the nature of base stations put pressure on system providers to reduce the size of system equipment, including filters.

One type of filter preferred by some communications system builders is the dual-resonant-mode multiple-cavity filter. However, because the dimensions of a cavity determine its resonant frequencies, filters of this design tuned to a particular frequency are so large that they cannot be used in some applications.

Accordingly, communications systems designers have developed improved filters of reduced size for use in systems, such as communications satellites, in which size is an absolute constraint. S. J. Fiedziuszko ("Dual-Mode Dielectric Resonator Loaded Cavity Filters," IEEE Transactions on Microwave Theory and Techniques, Vol. MTT-309, No.9, September 1982, see pp. 1311–1316), Tang et al. (U.S. Pat. No. 4,652,843), and Chandra Kudsia ("Innovations in Microwave Filters and Multiplexing Networks for Communications Satellite Systems," IEEE Transactions on Microwave Theory and Techniques, Vol. MTT-40, No.6, June 1992, see pp. 1133, 1140–1141, and 1148), each disclose dual-mode multiple-cavity filters employing dielectric resonators within the cavities. In such cavities, the resonant frequencies are primarily determined by the dimensions and dielectric constant of the resonators in addition to the dimensions of the cavities. Compared to ordinary cavities, suitable resonator-loaded cavities of a particular resonant frequency can be dramatically smaller.

The design of cavity filters depends largely on the resonant frequencies of the resonant elements (cavities or resonators), and the couplings between them. In the above-referenced articles and patent, the couplings between resonant elements are controlled by conductive irises having cross-shaped slit apertures aligned with the orthogonal planes or axes associated with the selected resonant modes of the filter. In general, the amount of coupling between parallel modes of adjacent resonators or cavities is related to the size of the iris slit oriented in the direction corresponding to that mode. Irises constructed as taught in the prior art are predominantly aligned parallel to the magnetic field components of the resonances they couple together.

Although filters of this basic design have provided excellent performance, while requiring only a fraction of the volume of ordinary dual-mode cavity filters, they are expensive. A large contributor to the cost of these filters is the need to manufacture the irises with precision. In addition, because the irises are generally not easily adjustable once manufactured and installed in a filter, other elements of the filter must also be precisely manufactured, usually at great expense.

Zaki U.S. Pat. No. 5,083,102 discloses dual-mode dielectric-resonator filters which do not require irises. Zaki provides a cylindrical cavity filter having a plurality of coaxial, longitudinally-spaced, dielectric resonators. Coupling and adjustment screws extend into the cavity through the cavity wall and, depending on their relative locations, affect the resonant frequency of the resonators, the coupling between resonant modes in a single resonator, or the coupling between resonant modes in adjacent resonators.

Although Zaki's filters do not require irises, and therefore generally may be constructed less expensively than iris-based filter designs, Zaki's filters are not as space-efficient as equivalent iris-based filter designs. In general, the distance between resonators establishes a lower limit on the coupling between parallel resonant modes of adjacent resonators. Zaki's coupling screws generally increase the coupling. In many filter designs, it is necessary to provide very large differentials in the coupling between various modes. In Zaki's filters, in order to achieve large differentials in coupling between parallel resonant modes of adjacent resonators, it is necessary to space the resonators widely so that selected couplings could be acceptably low. This renders the resulting filter unacceptably large for many applications.

OBJECTS AND SUMMARY OF THE INVENTION

It is therefore an object of the present invention to provide a small, high-performance radio-frequency filter which can be produced at relatively low cost. It is another object of the invention to provide a low-cost, high-performance radio-frequency filter which meets the size constraints of modern commercial applications.

It is a further object of the invention to provide an acceptably small, high- performance radio-frequency filter of the dual-mode dielectric-resonator-loaded cavity type which does not require an iris.

It is another object of the present invention to provide an improved method for controlling the coupling between parallel resonant modes on adjacent resonators in dual-mode dielectric-resonator-loaded cavity filters.

It is a further object of the present invention to provide a dual-mode dielectric-resonator-loaded cavity filter which provides components for reducing the coupling between parallel resonant modes on adjacent resonators.

It is another object of the present invention to provide an acceptably small, dual-mode dielectric-resonator-loaded cavity filter in which resonator frequencies may be easily adjusted after the filter is assembled.

It is a further object of the present invention to provide an acceptably small, dual-mode dielectric-resonator-loaded cavity filter in which couplings between resonant modes may be easily adjusted after the filter is assembled.

A dual-mode dielectric-resonator-loaded cavity filter constructed according to the present invention comprises a generally cylindrical cavity, at least two longitudinally-spaced dielectric resonator elements coaxially aligned within the cavity, and at least one coupling obstacle disposed between the resonators and extending between opposing cavity walls and parallel to electric field of the resonant modes the obstacle is intended to affect. The coupling obstacles are preferably conductive and are electrically connected to the cavity wall. However, the obstacles may be constructed of a dielectric material in some applications. Perpendicular reference planes are defined to correspond with the orthogonal resonant modes of the dielectric resonators. Each obstacle may be aligned with one of the reference planes to effectively control or reduce the coupling between the corresponding parallel resonant modes of adjacent resonators. The effect of the coupling obstacle is greatest if the obstacle passes through the center of the cavity, and is less pronounced if the obstacle does not pass through the center.

The reduction in coupling between resonant modes of adjacent resonators allows large coupling differentials to be produced, allowing a filter designer to implement a wide variety of high-performance filters without expensive irises. The coupling obstacle achieves the reduction in coupling without requiring large spacing between adjacent resonators. The coupling obstacles may be conveniently and inexpensively produced in bar, wire, hemi-disk, and other configurations. Several adjustments allow the resonators to be tuned, and the couplings to be adjusted, after the filter is assembled, thus reducing the complexity and expense of manufacture. In particular, the coupling obstacles are mounted for limited translation along the longitudinal axis of the cavity, and for rotation about their own longitudinal axes, thereby adjusting the amount of coupling reduction they provide.

BRIEF DESCRIPTION OF THE DRAWINGS

These and other features of this invention will be best understood by reference to the following detailed description of a preferred embodiment of the invention, taken in conjunction with the accompanying drawings, in which.

DETAILED DESCRIPTION OF THE PREFERRED EMBODIMENT

Figure 1:
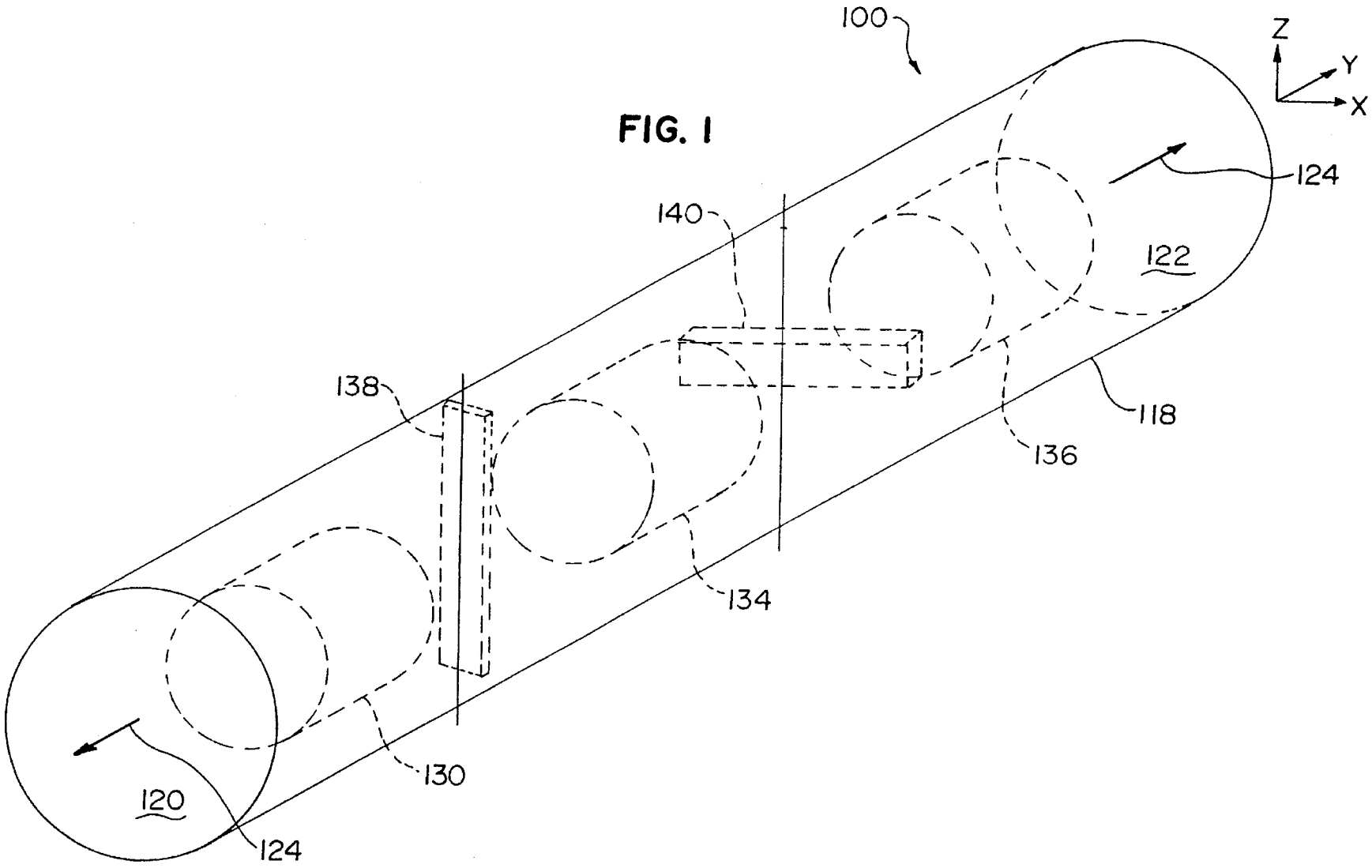
FIG. 1 is an oblique perspective view of a first embodiment of a filter constructed according to the present invention, with portions of the cavity wall cut away and certain components omitted for clarity.

A first preferred embodiment 100 of a dual-mode radio-frequency (RF) filter constructed according to the present invention is shown generally in FIGS. 1–9. The measured electrical performance of a prototype embodiment of this inventive filter is summarized in the graphs of FIGS. 12–15. It is believed that the present invention, implemented as generally described herein, is useful for constructing filters for use in communications and other RF applications in a range of frequencies extending from 200 MHz to 20 GHz. However, one skilled in the art will appreciate how to modify the invention disclosed herein to construct filters for use at frequencies outside this range.

As best seen in FIGS. 1–9, a first preferred embodiment 100 of a dual-mode RF filter constructed according to the present invention comprises a generally cylindrical cavity 118, first, second, and third dielectric resonator elements 130, 134, and 136, respectively, spaced within the cavity 118, a first coupling obstacle means 138 disposed between first and second resonator elements 130,134, and a second coupling obstacle means 140 disposed between second and third resonator elements 134, 136.

Cavity 118 may be any suitable generally cylindrical cavity and may be of conventional design. For reference, a central longitudinal axis 124 extending through the cavity is defined. The central axis 124 is parallel to the Y reference axis in the drawings. The cavity has a cylindrical wall 188 and first and second substantially planar end plates 120 and 122 defining an interior region 190. The cavity wall 188 and the end plates 120 and 122 may be formed using any suitable known technique and may be constructed of any appropriate conductive material. For example, cavity wall 188 and end plates 120 and 122 may be formed from copper, silver-plated aluminum, copper-clad INVAR brand alloy, or a dielectric material plated with a conductive metal.

Figure 1A:
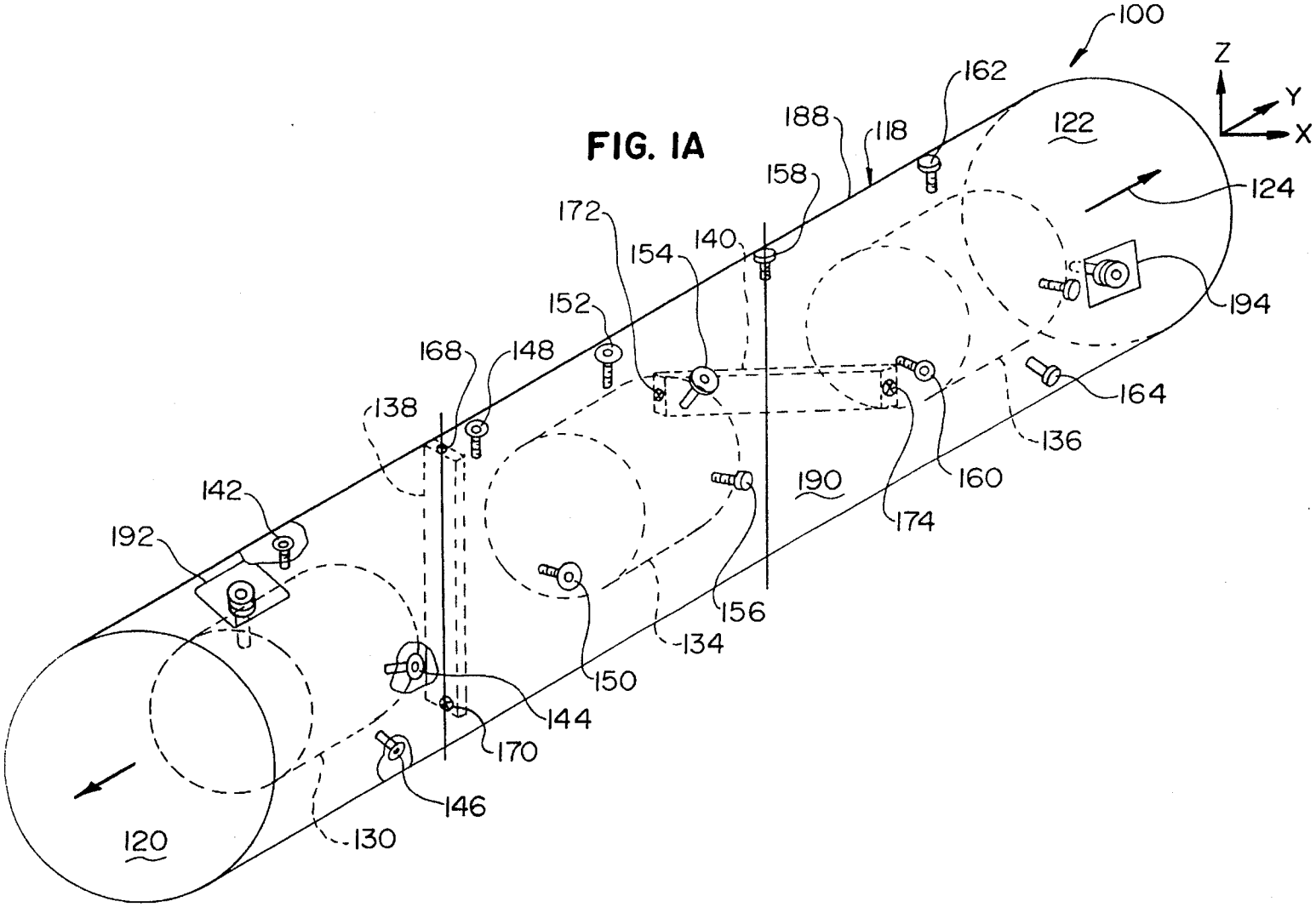
FIG. 1A is a second oblique perspective view of the filter of FIG. 1, showing the configuration of certain frequency and coupling adjustment components, in which portions of the cavity wall have been cut way and certain components have been omitted for clarity.
Figure 2:
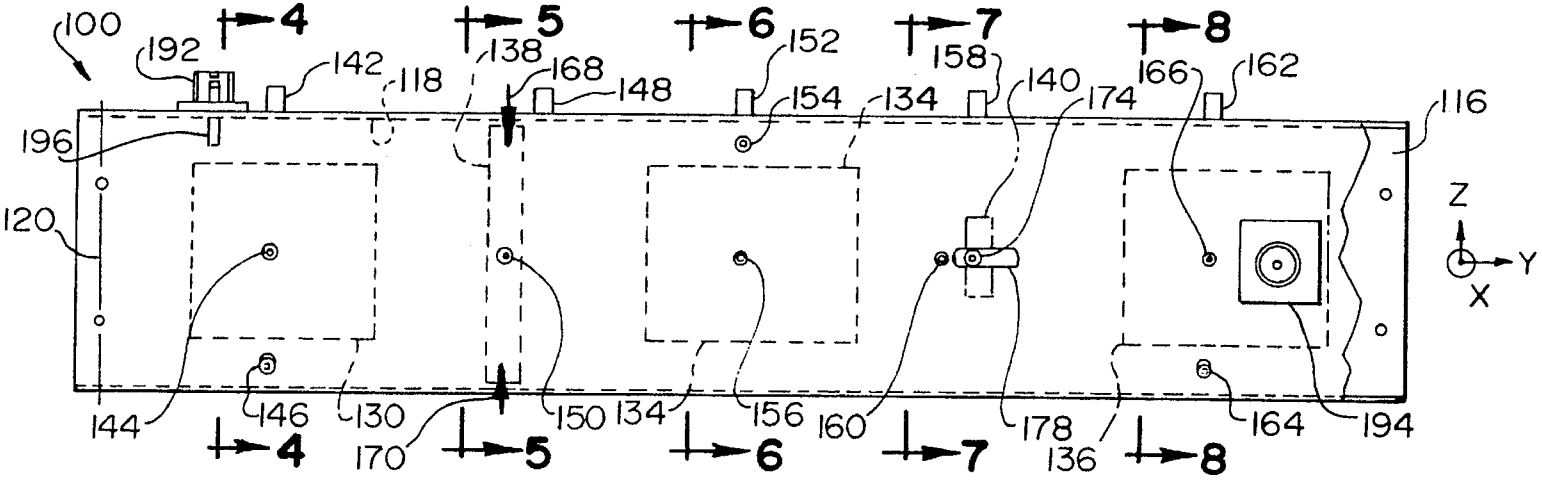
FIG. 2 is a side elevation view of the filter of FIG. 1, with certain structural components cut away, and certain internal components shown in phantom, for clarity.
Figure 3:
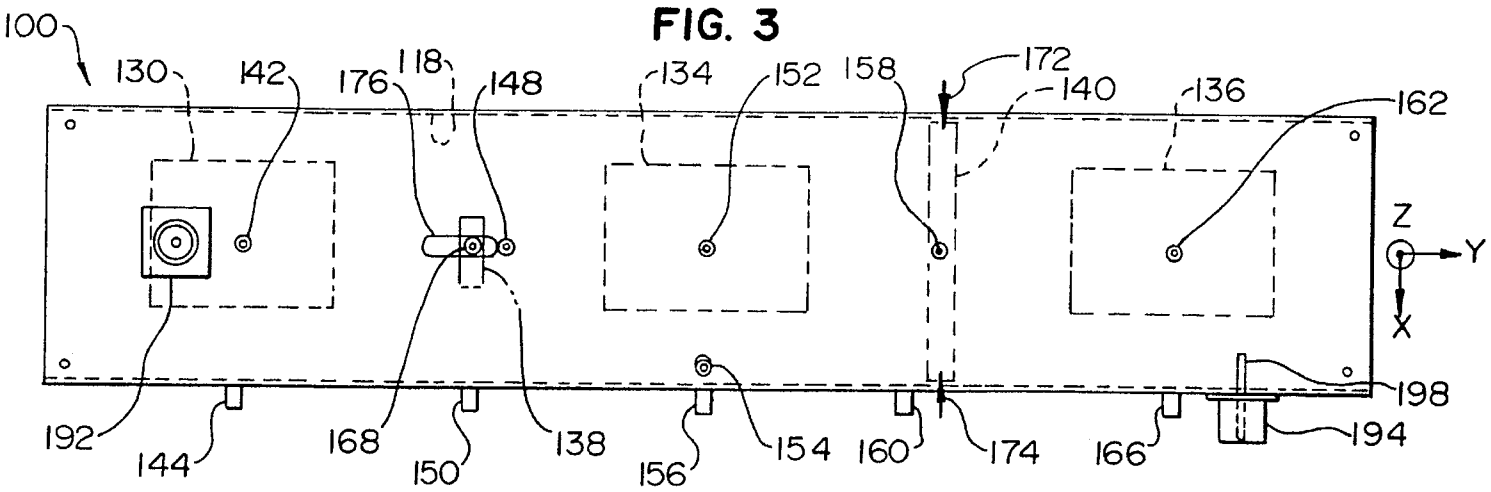
FIG. 3 is a top plan view of the filter of FIGS. 1–2, with certain internal components shown in phantom for clarity.
Figure 4:
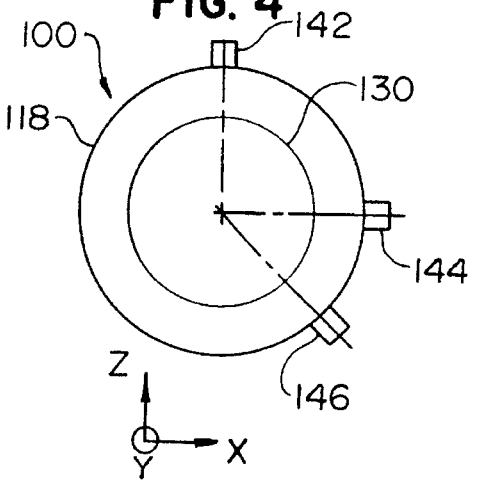
FIG. 4 is a longitudinal cross-section view of the filter of FIG. 1, taken through the plane identified by view lines 4—4 of FIG. 2.
Figure 5:
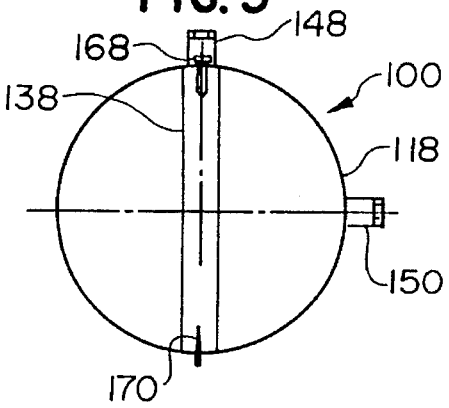
FIG. 5 is a longitudinal cross-section view of the filter of FIG. 1, taken through the plane identified by view lines 5—5 of FIG. 2.
Figure 6:
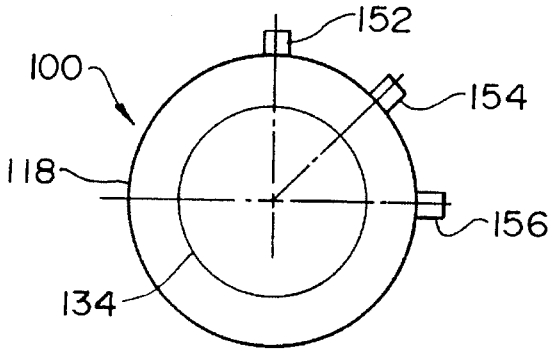
FIG. 6 is a longitudinal cross-section view of the filter of FIG. 1, taken through the plane identified by view lines 6—6 of FIG. 2.
Figure 7:
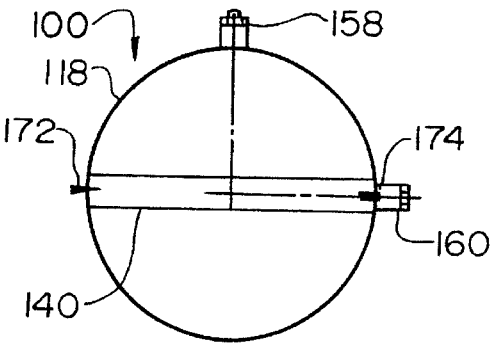
FIG. 7 is a longitudinal cross-section view of the filter of FIG. 1, taken through the plane identified by view lines 7—7 of FIG. 2.
Figure 8:
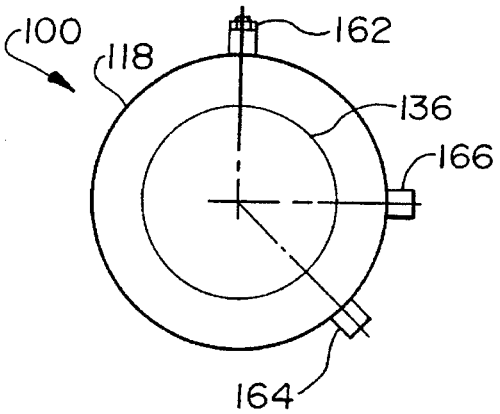
FIG. 8 is a longitudinal cross-section view of the filter of FIG. 1, taken through the plane identified by view lines 8—8 of FIG. 2.
Figure 9:
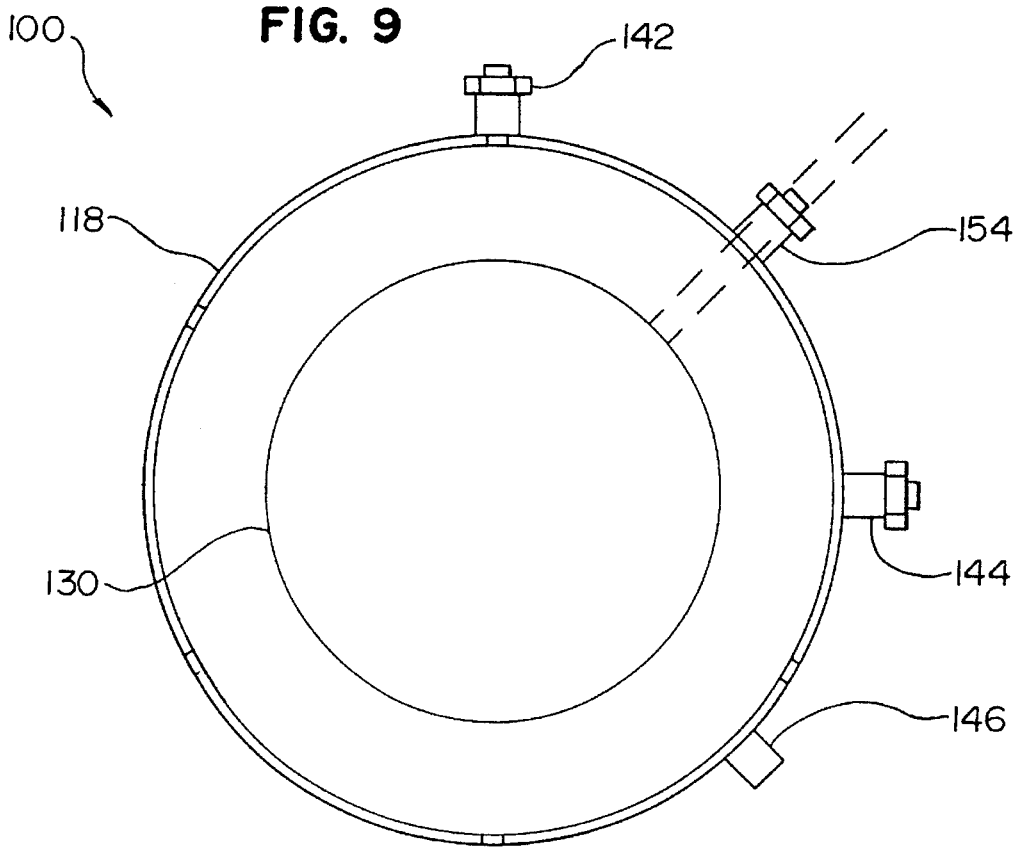
FIG. 9 is an end elevation view of the filter of FIG. 1.

As best seen in FIGS. 1A, 2, and 3, filter 100 preferably includes suitable ports 192 and 194 for coupling the filter into an external circuit (not shown). Ports 192 and 194 may be implemented using any appropriate RF connectors, such as type "N" connectors. Structures 196,198 may be provided to establish a coupling between the external circuit connected to the connectors 192,194 to resonator elements 130,136, respectively. Structures 196 and 198 may take the form of an open-circuited probe, extending the center conductors of connectors 192 and 194. The input probe 196 is aligned parallel to the vertical resonant mode of resonator 130. The output probe 198 is aligned parallel to the horizontal resonant mode of resonator 136. The amount of coupling between the probes 196,198 and the associated resonators depends on the proximity of the probe to the resonators, the length of the probe, and the probe diameter. This coupling is typically adjusted to satisfy application requirements and the appropriate value is normally found by trial and error.

Dielectric resonator elements 130,134, and 136 may be any dielectric resonators suitable for use in cylindrical cavity filters. In general, such resonators have a generally cylindrical shape with a central longitudinal axis. Preferably, the resonators 130,134, and 136 are oriented coaxially within the interior region 190 of cavity 118 and are arranged in a suitable longitudinally spaced relationship. For example, the length of the cavity 118 may be divided longitudinally into one-third portions, with each resonator 130, 134, and 136 disposed in the approximate center of a respective portion.

The required resonator dimensions to achieve a desired resonant frequency may be calculated using methods known in the art. See, for example, the Fiedziuszko article cited previously. Suitable cavity dimensions may also be calculated using methods known in the art. In a prototype embodiment discussed further herein, solid resonators were used, having a length of approximately 2.72 inches and a diameter of approximately 2.72 inches. However, other configurations may be used, depending on application requirements.

Typically, dielectric resonators 130,134, and 136 are constructed of a high-dielectric-constant ceramic material selected for appropriate electrical, mechanical, thermal, and cost characteristics. However, dielectric resonators 130, 134, and 136 may be constructed of any suitable material. In a prototype embodiment of the invention, acceptable results were achieved using resonators constructed of Zinc Titanate and having a dielectric constant of approximately 36. Zinc Titanate resonator material is commercially available from Trans-Tech Incorporated, 5520 Adamstown Rd., Adamstown, Md. 21710, under the trade name "8500 Series." However, Barium Titanate, which is also commercially available for resonator construction, could also be used.

Resonators 130, 134, and 136 may be mounted and supported in cavity 118 using any suitable mounting components. For example, resonators 130, 134, and 136 may be supported radially and longitudinally using non-conductive dielectric foam elements (not shown) shaped to conform to the interstitial region between the cavity wall and the resonator bodies. A polystyrene foam may be used for this purpose. The performance obtained from a prototype filter embodiment employing the foam mounting elements is believed to be acceptable in some applications. However, improved temperature stability and insertion loss may be obtained using other known mounting components. Resonators 130, 134, and 136 may be separated using longitudinal spacers. As is known in the art, such spacers and mounting components are preferably constructed of a suitable, low loss dielectric material.

In dual-mode dielectric-resonator-loaded filters of the type discussed herein, each resonator operates in two resonant modes. For filter design purposes, the modes are generally tuned to the same resonant frequency and the modes may be considered to be aligned with arbitrarily defined orthogonal reference planes extending through the central longitudinal axis of the resonators. Since the resonators are coaxially aligned with the cavity, they share the central axis 124. For reference herein, the one resonant mode is called the "vertical mode" and is defined to be aligned with the Y-Z plane, and the other resonant mode is called the "horizontal mode" and is defined to be aligned with the X-Y plane.

As is known in the art, the design of filters of this general type depends largely on the resonant frequencies of the resonant elements (cavities or resonators), and the couplings between them. Since dual-mode resonators operate in two resonant modes, the filter design depends on the resonant frequency of each mode of each resonator and the couplings between all resonant modes of all resonators. In general, the distance between resonators establishes a lower limit on the coupling between parallel resonant modes. Additional structures provided within the filter cavity, for example, coupling adjustment screws, generally increase the coupling. In many filter designs, it is necessary to provide a very large difference between the couplings between two pairs of parallel modes on adjacent resonators. For instance, the coupling of one pair of parallel modes may be as much as an order of magnitude smaller than the coupling between the orthogonal pair of adjacent parallel modes. As discussed previously, one problem with some prior-art filters is that in order to provide large differentials in coupling between parallel resonant modes of adjacent resonators, it was necessary to space the resonators widely such that selected couplings could be acceptably low.

According to one aspect of the present invention, this problem is advantageously solved by interposing coupling obstacles 138 and 140 between adjacent resonators. The coupling obstacles 138, 140 are preferably aligned with the reference plane corresponding to the resonant mode the coupling obstacle is intended to affect. For example, coupling obstacle 138 is oriented vertically between resonators 130 and 134, and therefore primarily affects the coupling between the vertical resonant modes of resonators 130 and 134, i.e., the resonant mode having a vertically oriented electric field. Coupling obstacle 140 is oriented horizontally between resonators 134 and 136, and therefore primarily affects the coupling between the horizontal resonant modes of resonators 134 and 136. According to an accepted model of dual-mode filter operation, the electric and magnetic fields by which resonant modes interact are concentrated in the neighborhood of the reference plane with which the mode is aligned. Accordingly, the coupling obstacles reduce the coupling by an amount related to the degree to which the obstacle occludes the concentrated field region surrounding the reference plane.

Figure 10:
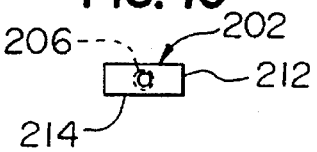
FIG. 10 is a top plan view of a first embodiment of a coupling obstacle for use with the filter of FIG. 1.
Figure 11:
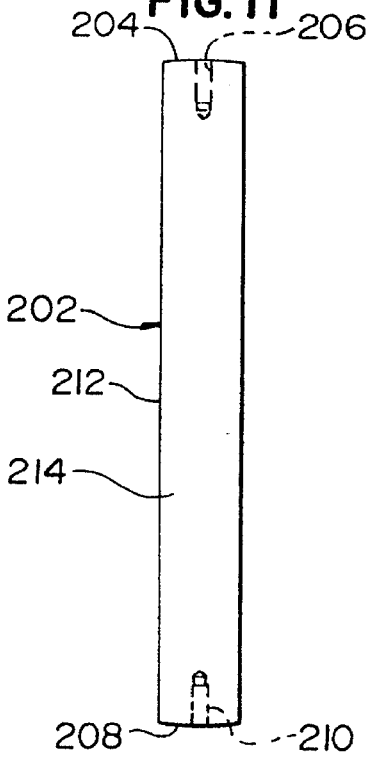
FIG. 11 is a side elevation view of the coupling obstacle of FIG. 10.
Figure 12:
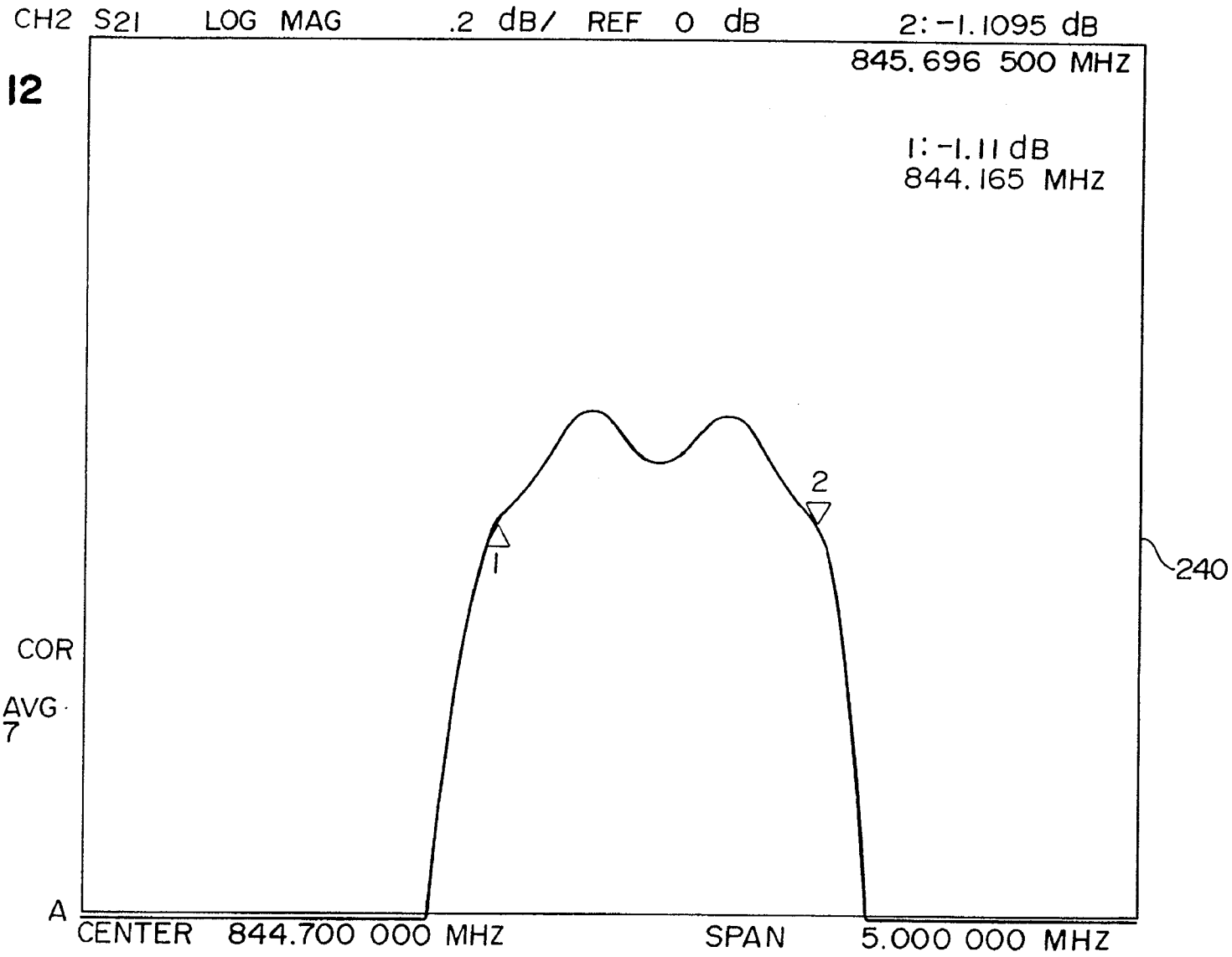
FIG. 12 is a graph showing the "passband loss" electrical performance of a prototype embodiment of the inventive filter of FIGS. 1–9.
Figure 13:
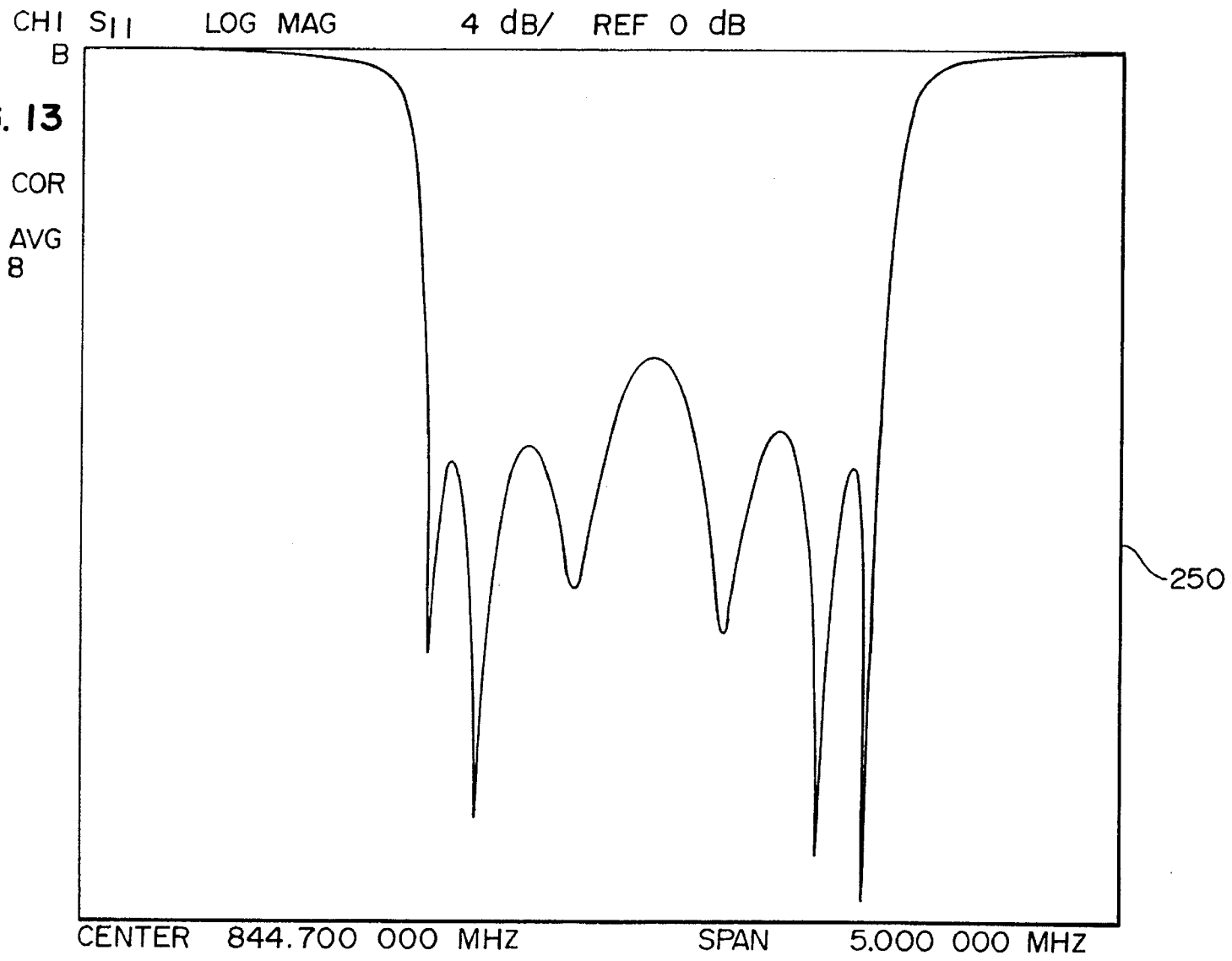
FIG. 13 is a graph showing the measured "return loss" electrical performance of a prototype embodiment of the inventive filter of FIGS. 1–9.
Figure 14:
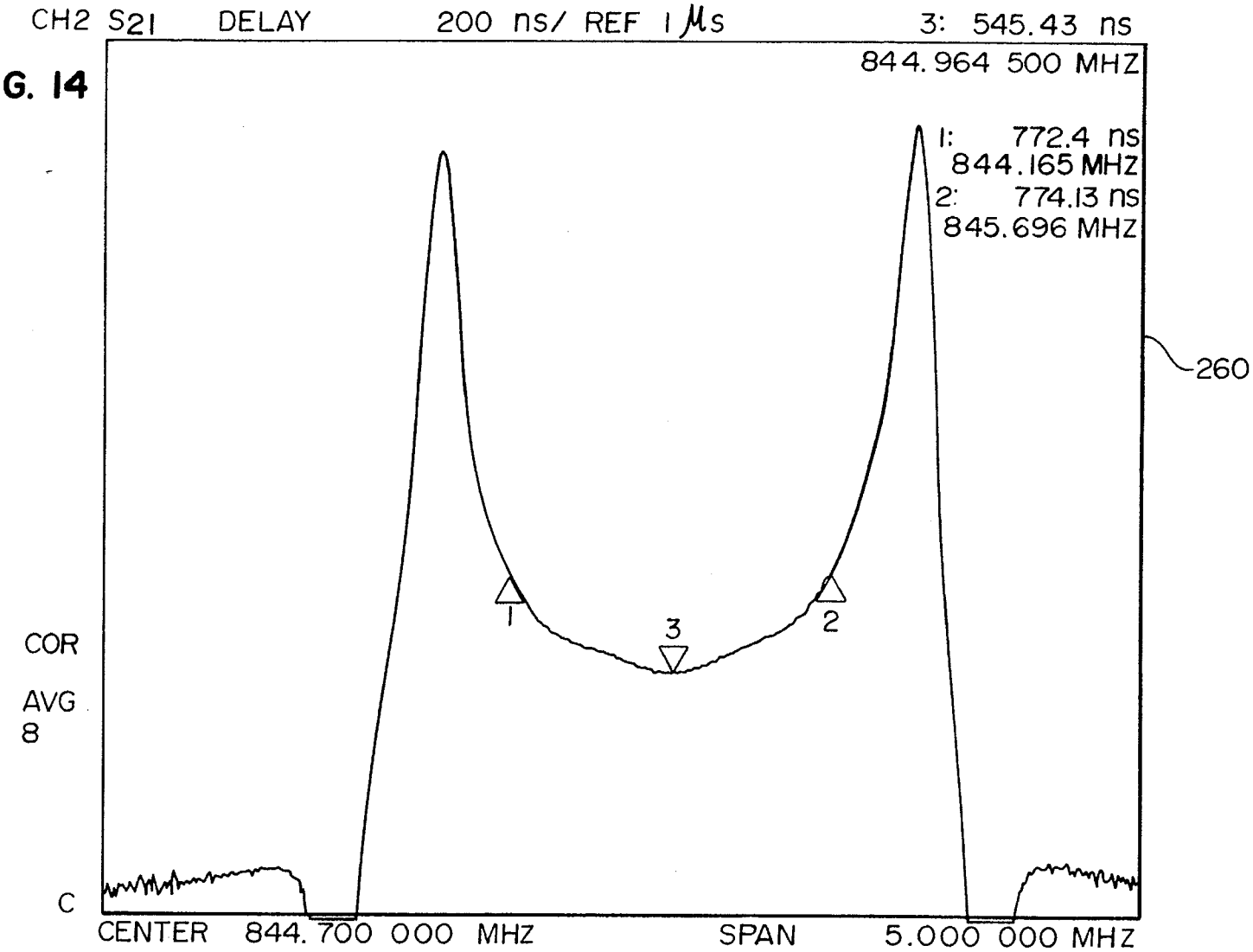
FIG. 14 is a graph showing the measured "group delay" electrical performance of a prototype embodiment of the inventive filter of FIGS. 1–9.
Figure 15:
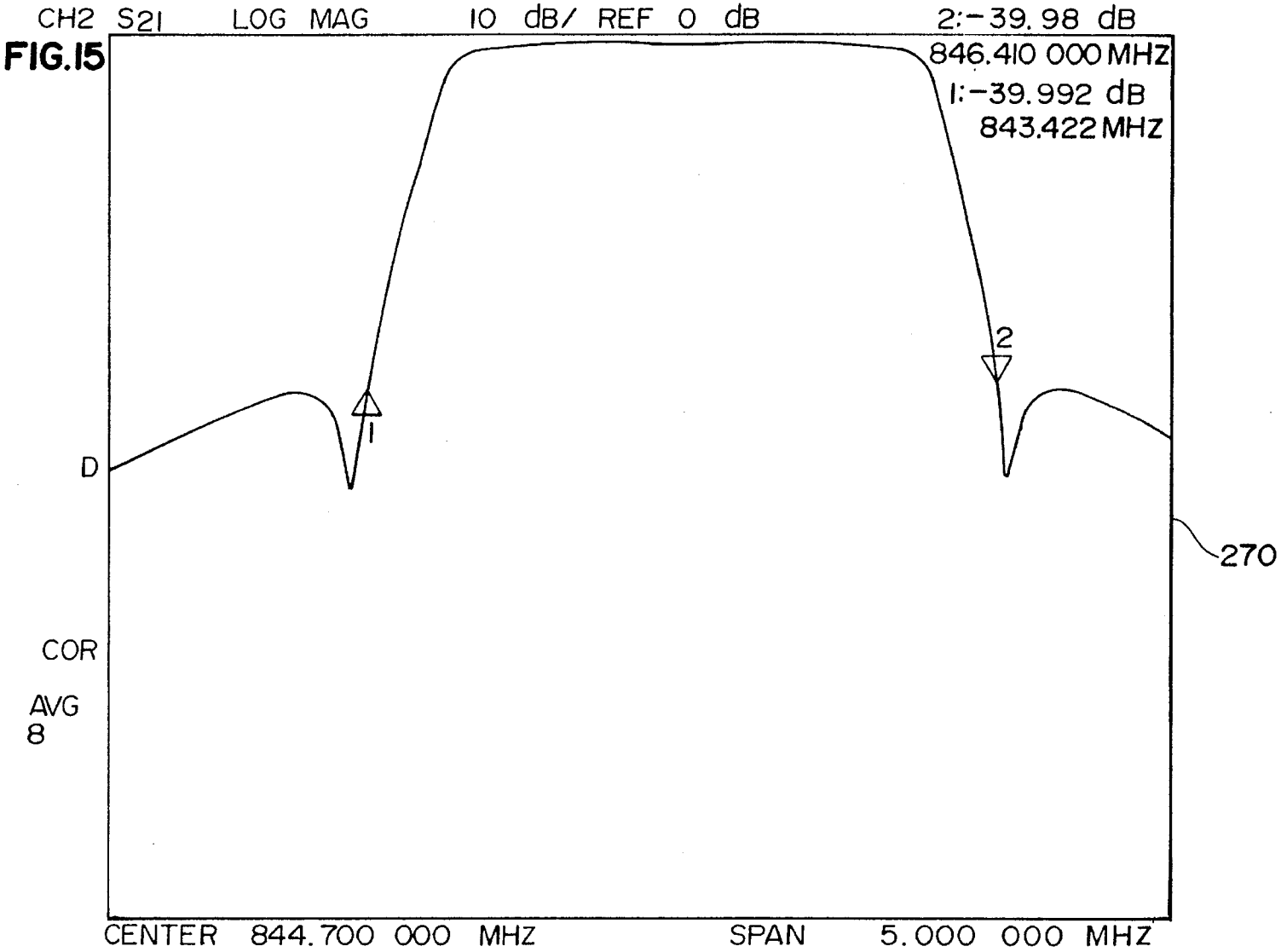
FIG. 15 is a graph showing the measured "bandpass filter attenuation response" electrical performance of a prototype embodiment of the inventive filter of FIGS. 1–9.

According to one aspect of the invention, a preferred embodiment of a coupling obstacle 202 suitable for use in filter 100 is best seen in FIGS. 10 and 11. Obstacle 202 may be used to implement coupling obstacles 138 and 140 of filter 100. Obstacle 202 may be formed as a bar-shaped member having a rectangular cross-section. If the obstacle cross-section is square, rotation of the obstacle by an angular displacement which is not an integral multiple of 90 degrees will result in variation of the coupling. Preferably, the width of the bar in one dimension (e.g. along planar front surface 214) is substantially greater than that in the perpendicular dimension (e.g. along planar side surface 212). This differential width allows the reduction in coupling provided by the obstacle 202 to be adjusted by rotating the obstacle about its longitudinal axis and thereby varying the degree to which the obstacle occludes the region near the reference plane with which it is aligned. If the obstacle cross-section is square, rotation of the obstacle by an angular displacement which is not an integer multiple of 90 degrees will result in variation of the coupling. Preferably, however, it is not square, because a non square cross-section increases the range of coupling adjustment available through rotation of the obstacle. Preferably, the length of the bar is slightly less than the diameter of the cavity 118. Rounded upper and lower cavity interface surfaces 204 and 208 may be provided to match the curvature of the cavity. Tapped sockets 206 and 210 are preferably provided to receive fasteners, e.g. 168, 170, 172, and 174 (see FIGS. 1A, 2, and 3) for securing the obstacle 202 in a desired position within the cavity 118.

In a preferred embodiment of the invention, obstacle 202 is constructed of a conductive material which has temperature characteristics compatible with the material from which the cavity 118 is constructed. For example, where copper is used as the primary cavity construction material, copper may also be advantageously used to construct the obstacle 202. However, other conductive materials could also be used. Once installed, the obstacle 202 is preferably in electrical contact with the cavity wall. In some applications, however, acceptable results may be obtained by constructing obstacle 202 from a dielectric material.

As best seen in FIGS. 1–8, the coupling obstacles 138 and 140 extend through the central axis 124. Therefore, although obstacle 138 is intended to affect the coupling between vertical resonant modes of resonators 130 and 134, it also passes through the horizontal reference plane. Since a cross-sectional portion of obstacle 138 is present in the concentrated field region surrounding the horizontal reference plane, the coupling obstacle 138 will have some effect on the coupling between the horizontal resonant modes of resonators 130 and 134. However, because the cross-section of obstacle 138 is small compared to its profile, its effect on the coupling of adjacent horizontal modes will be much smaller than its effect on the coupling of the adjacent vertical modes.

Although a particular configuration has been described for coupling obstacle 202, other configurations may also be used. In particular, although the coupling obstacles 138 and 140 of FIGS. 1–9 and obstacle 202 of FIGS. 10–11 have a rectangular cross- section and extend through central axis 124, other embodiments may be constructed in which the coupling obstacles have different shapes or do not extend through the central axis 124. Several additional coupling obstacle embodiments, which may be advantageously used in filters according to the present invention, are described further.

According to another aspect of the present invention, several structural features are provided to allow adjustment of the electrical characteristics of filter 100 and its components. As discussed above, a disadvantage of prior art filters employing irises for controlling coupling is that the irises are generally not adjustable and therefore must be precisely manufactured. Prior art adjustable filters which have lacked irises have been large. The adjustment structures of the present invention thus advantageously permit construction of a small, adjustable filter.

For each resonator, adjustment means are preferably provided for controlling the resonant frequency of the horizontal mode, the resonant frequency of the vertical mode, and the coupling between the horizontal and vertical modes in that resonator. In a preferred embodiment of the invention, the adjustment means may be implemented as a conductive incursion from the cavity wall toward the resonator (in the direction of the central axis 124). For example, the adjustment means may be a conductive screw entering the cavity from the exterior through a suitable aperture. The screw may be formed from any appropriate conductive material (usually a metal), such as copper, silver-plated steel, or silver-plated brass.

In order to provide adjustment means for controlling the frequency of a particular resonant mode of a resonator, an incursion is preferably provided near the resonator and aligned along the reference plane associated with that resonant mode. For example, adjusting screws 142, 152, and 162 (FIGS. 1A, 2, 3, 4, 6, and 8) are aligned with the Y-Z plane and are provided to adjust the frequency of the vertical resonant modes of resonators 130, 134, and 136, respectively. Adjusting screws 144, 156, and 166 are aligned with the X-Y plane and are provided to adjust the frequency of the horizontal resonant modes of resonators 130, 134, and 136, respectively.

In order to provide adjustment means for controlling the coupling between the horizontal and vertical resonant modes of a single resonator, an incursion is preferably provided near the resonator and unaligned with the resonant mode reference planes. For example, adjusting screws 146, 154, and 164 (FIGS. 1A, 2, 3, 4, 6, and 8) are provided to adjust the coupling between the horizontal and vertical resonant modes of resonators 130, 134, and 136 respectively. Adjusting screws 146, 154, and 164 are angularly displaced 45 degrees from each reference plane. Although the screws need not be evenly angularly displaced from both reference planes, such positioning maximizes the effect the adjusting screws have on inter-mode coupling, and minimizes the effect the adjusting screws have on the resonator frequencies. As the adjusting screw is displaced toward a particular reference plane, the effect of the adjusting screw on the frequency of the corresponding resonant mode increases, and the effect on inter-mode coupling decreases.

The adjusting screws which are associated with the characteristics of a particular resonator (i.e., 142, 152, 162, 144, 156, 166, 146, 154, and 164) are preferably aligned near the longitudinal midpoint of the respective resonator. Although the adjusting screws may operate effectively even if displaced from this location, such displacement reduces the effect the adjusting screw has on the intended resonator, and increases the effect the adjusting screw has on nearby resonators.

For each pair of adjacent resonators, additional means are preferably provided for adjusting the amount of coupling between parallel or corresponding resonant modes of the adjacent resonators. Like the single-resonator adjustment means described above, these resonator-pair adjustment means take the form of conductive incursions from the cavity wall toward the central axis 124, and may be implemented as conductive screws entering the cavity.

To adjust the coupling between the parallel resonant modes of two adjacent resonators, an incursion is preferably provided approximately longitudinally midway between the two resonators and is aligned with the reference plane associated with those resonant modes. For example, adjusting screws 148 and 158 (FIGS. 1A, 2, 3, 5 and 7) are aligned with the Y-Z plane and are provided to adjust the coupling between the vertical resonant modes of resonator pairs 130–134 and 134–136, respectively. Adjusting screws 150 and 160 are aligned with the X-Y plane and are provided to adjust the coupling between the horizontal resonant modes of resonator pairs 130–134 and 134–136, respectively. Increasing the length of the incursion into the cavity increases the coupling between the corresponding modes.

To adjust the coupling between non-parallel modes of adjacent resonators, adjustment screws (not shown) may be provided longitudinally midway between the two resonators, but unaligned with either reference plane.

Although the inter-resonator coupling adjustment screws 148, 150, 158, and 160 are preferably located longitudinally midway between pairs of adjacent resonators, it may be necessary to displace the adjustment screws from their ideal positions to avoid interference with coupling obstacles 138, 140 or other structures. As best seen in FIGS. 2–3, adjustment screws 148 and 160 have been so displaced. Longitudinal displacement of an adjustment screw toward a resonator increases the effect of the screw on the frequency of that resonator.

Means are preferably also provided to allow adjustment of the coupling obstacles 138,140 by translation along the longitudinal axis 124 of the filter and by rotation about the longitudinal axis of the obstacle. Coupling obstacles 138, 140 are nominally located midway between adjacent resonators. In order to permit translation of the obstacles 138, 140, small longitudinal slits 168 (FIG. 3) and 178 (FIG. 2) may be provided in the walls of cavity 118 to receive suitable obstacle mounting fasteners 168, 170, 172,174. Obstacle mounting fasteners 168, 170, 172,174 may be any suitable fasteners compatible with mating sockets provided in the obstacles 138,140. See sockets 206 and 210 of obstacle 202 (FIGS. 10–11). For example, the fasteners may be conventional threaded screws. The screws may be loosened to allow adjustment and may be tightened to prevent further displacement. Adjustment of the longitudinal position of the obstacle is effective for obstacles of any shape or cross-section. Such adjustment tends to affect almost exclusively the coupling of parallel resonant modes (of adjacent resonator pairs) corresponding to the reference plane with which the obstacle is aligned.

The above-described adjustable obstacle mounting arrangement advantageously also permits rotation of the obstacle about its own central longitudinal axis. The adjustment effect relies on the varying degree to which the obstacle occludes the region near the reference plane with which the obstacle is aligned. Accordingly, adjustment of the obstacle by axial rotation is effective only for obstacles of non-circular cross-section, unless an eccentric axis is chosen. In addition, adjustment of the obstacle by axial rotation tends to affect the coupling of both sets of parallel resonant modes (on adjacent resonator pairs), and not just the set corresponding to the reference plane with which the obstacle is aligned.

FIGS. 12–15 are graphs showing certain measured electrical performance characteristics of a prototype embodiment of the inventive filter constructed generally according to the discussion above. The prototype embodiment was designed as a bandpass filter for the 845–846.5 MHz portion of the U.S. cellular "non-wireline" or "A" band, which is allocated for use by base stations receiving signals from subscriber terminals. The filter was designed as a 6 pole, two zero, dual-mode, dielectric-resonator, longitudinal, quasi-elliptic filter, employing three physical resonators (i.e. six resonances). Design goals included a 1.5 MHz wide passband, a 3.1 MHz stopband, 40 dB attenuation in the adjacent wireline basestation receive band (see FIG. 15), and 1 dB insertion loss in the passband (see FIG. 12).

Graph 240 (FIG. 12 ) shows the "passband loss" performance of the prototype filter. Curve "A" indicates a passband loss of less than approximately 1.11 dB over the frequency range of 844.2 to 845.7 MHz.

Graph 250 (FIG. 13) shows the "return loss" performance of the prototype filter. Curve "b" indicates a return loss of less than approximately 14 dB over the frequency range of 844.1 to 845.3 MHz.

Graph 260 (FIG. 14) shows the "group delay" performance of the prototype filter. Curve "C" indicates a group delay of less than approximately 775 ns over the frequency range of 844.2 to 845.7 MHz.

Graph 270 (FIG. 15) shows the "bandpass filter attenuation response" performance of the prototype filter near its design frequency. Curve "D" indicates that the filter provides at least 40 dB attenuation outside of the stopband limits of approximately 843.4 MHz and 845.4 MHz, respectively.

Figure 16:
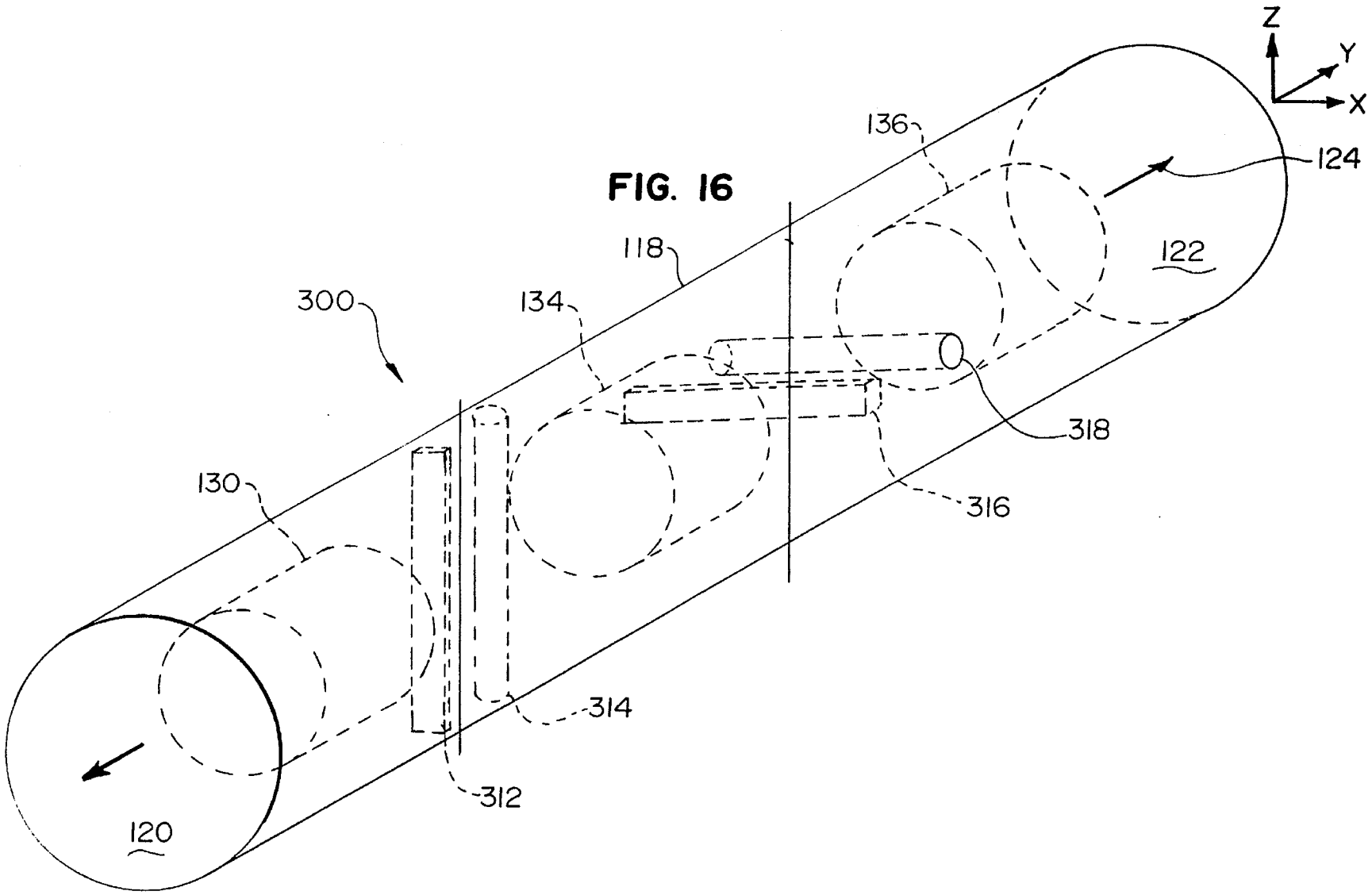
FIG. 16 is an oblique perspective view of a second embodiment of a filter constructed according to the present invention, with portions of the cavity wall cut away and certain components omitted for clarity.

FIG. 16 is an oblique perspective view of a second preferred embodiment 300 of a dual-mode RF filter constructed according to the present invention. With the exception of the construction and arrangement of the coupling obstacles, embodiment 300 may be constructed in a manner identical to embodiment 100. Components which are identical in both embodiments have been assigned identical reference numbers. Filter 300 comprises a generally cylindrical cavity 118, first, second, and third dielectric resonator elements 130, 134, and 136, respectively, spaced within the cavity 118, first and second coupling obstacle means 312, 314 disposed between first and second resonator elements 130, 134, and third and fourth coupling obstacle means 316, 318 disposed between second and third resonator elements 134, 136. Coupling obstacles 312 and 314 are arranged as a longitudinally spaced pair of bar-shaped members. Coupling obstacles 316 and 318 are similarly arranged. Obstacles 312, 314, 316 and 318 may have any suitable cross-sections. As best seen in FIGS. 10–11, obstacles 312 and 316 may be constructed with rectangular cross-sections, and obstacles 314 and 318 may be constructed with circular cross sections. This provides advantages in that the circular-cross-section obstacles may be less expensive to manufacture, while the rectangular-cross-section obstacles allow coupling adjustment by axial rotation. The use of paired obstacles may provide increased control (i.e., a further reduction in coupling) over that provided by a singular obstacle.

Figure 17:
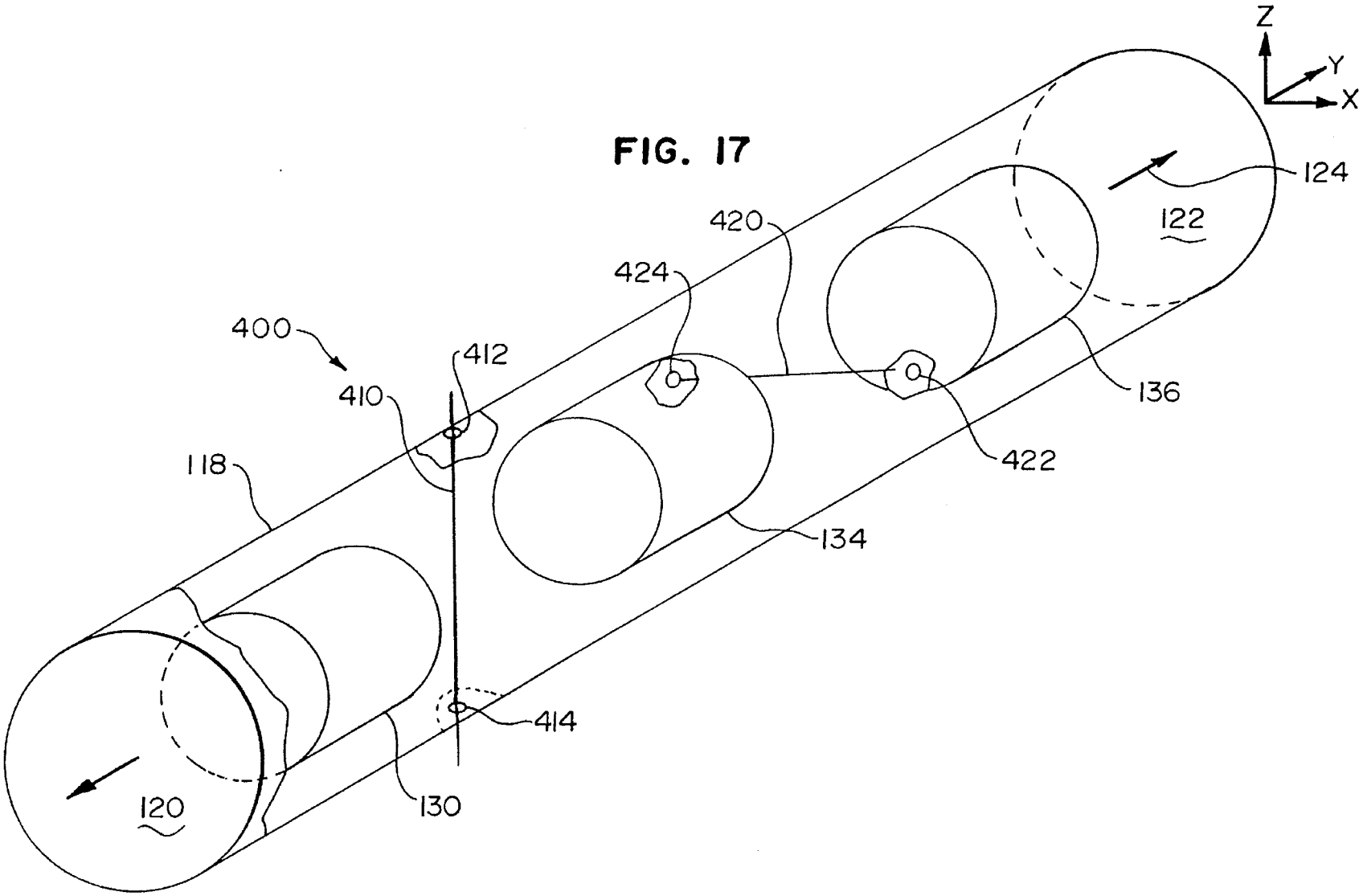
FIG. 17 is an oblique perspective view of a third embodiment of a filter constructed according to the present invention, with portions of the cavity wall cut away and certain components omitted for clarity.

FIG. 17 is an oblique perspective view of a third preferred embodiment 400 of a dual-mode RF filter constructed according to the present invention. With the exception of the construction and arrangement of the coupling obstacles, embodiment 400 may be constructed in a manner identical to embodiment 100. Components which are identical in both embodiments have been assigned identical reference numbers. Filter 400 comprises a generally cylindrical cavity 118, first, second, and third dielectric resonator elements 130, 134, and 136, respectively, spaced within the cavity 118, first coupling obstacle means 410 disposed between first and second resonator elements 130, 134, and second coupling obstacle means 420 disposed between second and third resonator elements 134,136. Coupling obstacle 410 is preferably formed as a thin, conductive wire segment which enters the cavity 118 through a first aperture 412 and exits the cavity 118 through a second aperture 414. Coupling obstacle 420 is preferably similarly formed and enters the cavity 118 through a first aperture 422 and exits the cavity 118 through a second aperture 424. The coupling obstacles are preferably electrically connected to the wall of cavity 118.

Although the obstacles 410 and 420 may pass through the central axis 124 of the cavity, the concentration of fields in that region and the small cross-section of the obstacles 410, 420 combine to make the filter highly sensitive to small changes in position and effective size of the wire. This is a particular problem in low temperature environments, because frost may form on the wire, enlarging its effective cross-section and dramatically changing the characteristics of the filter. Accordingly, in many applications it will be preferred that the obstacles be located off-center such that their paths avoids the neighborhood of central axis 124.

Figure 18:
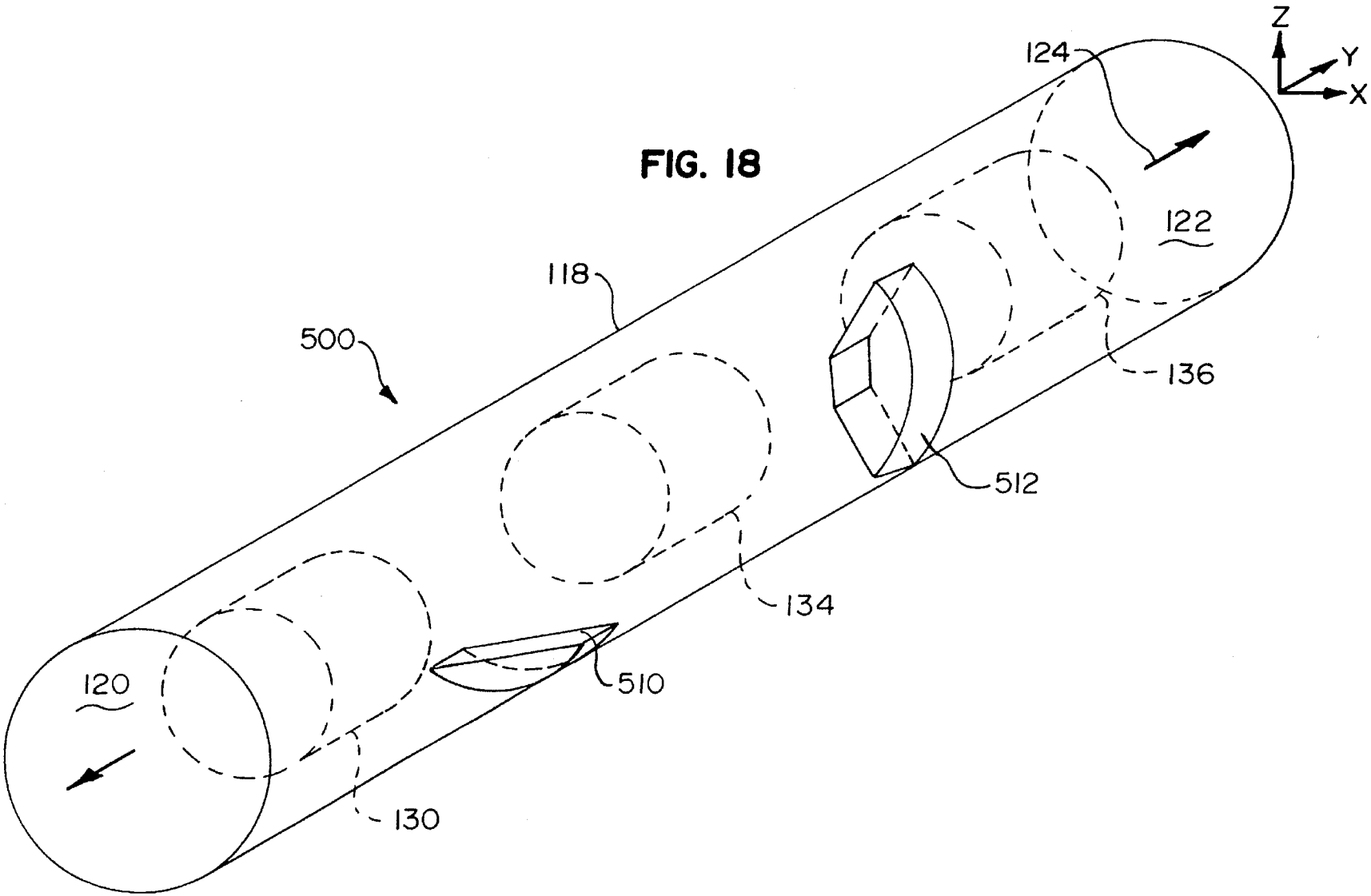
FIG. 18 is an oblique perspective view of a fourth embodiment of a filter constructed according to the present invention, with portions of the cavity wall cut away and certain components omitted for clarity.

FIG. 18 is an oblique perspective view of a fourth preferred embodiment 500 of a dual-mode RF filter constructed according to the present invention. With the exception of the construction and arrangement of the coupling obstacles, embodiment 500 may be constructed in a manner identical to embodiment 100. Components which are identical in both embodiments have been assigned identical reference numbers. Filter 500 comprises a generally cylindrical cavity 118, first, second, and third dielectric resonator elements 130, 134, and 136, respectively, spaced within the cavity 118, first coupling obstacle means 510 disposed between first and second resonator elements 130, 134, and second coupling obstacle means 512 disposed between second and third resonator elements 134, 136. Coupling obstacles 510 and 512 are preferably formed as truncated portions of a circular disk: having a diameter similar to that of the cavity and are preferably mounted touching or closely adjacent to the cavity wall. The disk portions may have an area less than half that of a full circle of equal diameter, and thus do not extend through the neighborhood of the cavity central axis 124. Obstacle means 510 is substantially truncated. Obstacle means 512 is substantially wedge-shaped, and the acute portion of the wedge which would extend near the center of the cavity has been truncated.

The preferred filter embodiments discussed above present a variety of alternatives for constructing and arranging coupling obstacles for advantageously achieving small, high-performance, low-cost RF filters. One skilled in the art will appreciate that the disclosed embodiments may be modified in other ways consistent with the spirit of the invention. Although the coupling obstacles disclosed herein are shown aligned with one of the defined reference planes, they could also be placed in filters in an orientation unaligned with the reference planes in order to achieve coupling between perpendicular resonant modes on adjacent resonators.

Further, although the embodiments disclosed herein present filters of the cylindrical cavity type in which a plurality of dielectric resonators are coaxially aligned with the central longitudinal axis of the cavity, it will be appreciated that the present invention for controlling coupling in RF filters may be used in other filter applications in which irises or similar coupling control techniques have conventionally been used. In particular, coupling obstacles constructed according to the invention may be used in "rectangular" cavity filters in which resonators are coaxially or non-coaxially aligned. In addition, although the dielectric resonator elements shown and described herein are generally cylindrically shaped, the invention could be applied in filters having non-cylindrical resonators. Further, the inventive filter embodiments disclosed herein each have three resonator elements with one or more coupling; obstacles interposed therebetween. However, the invention could be advantageously applied to filters having a different number of resonators by interposing one or more coupling obstacles between each adjacent pair of resonators.

In addition to visible structural differences between irises used in prior art filters and the coupling obstacles of the present invention, these components also differ in the fundamental ways they affect the couplings between resonant elements in a filter. Irises constructed as taught in the prior art are predominantly aligned parallel to the magnetic field components of the resonances they couple together. In contrast, the coupling obstacles of the present invention are predominantly aligned parallel to the the electric field components of the resonances they couple.

The above-described embodiments of the invention are merely examples of ways in which the invention may be carried out. Other ways may also be possible, and are within the scope of the following claims defining the invention.

What is claimed is:

1. A radio-frequency filter comprising:

an enclosure;

at least first and second dielectric resonators disposed coaxially within said enclosure in a spaced longitudinal relationship;

each of said resonators being adapted to resonate in first and second resonant modes;

said first and second resonant modes being orthogonal;

said first resonant modes of said first and second resonators being parallel;

said first resonant modes of said first and second resonators being subject to electromagnetic coupling;

said coupling having an electric field component and a magnetic field component;

obstacle means disposed within said enclosure and positioned longitudinally between said first and second resonators to reduce said coupling;

said obstacle means predominantly disposed parallel to said electric field component of said coupling;

wherein said enclosure has at least one wall surface and said coupling obstacle means is a volumetric solid having at least first and second exterior edge contour sections, said first contour section having a shape matching that of said wall surface, said obstacle means being disposed within said enclosure such that said first contour section contacts said wall surface substantially over the entire extent of said first contour section, and said second contour section is substantially out of contact with any wall section.

2. The device of claim 1 wherein said enclosure is a generally cylindrical conductive cavity.

3. The filter of claim 1 wherein said coupling obstacle means is formed as a substantially solid bar of conductive material.

4. The filter of claim 1 wherein said coupling obstacle means is formed as a thin conductive wire.

5. The filter of claim 1 wherein said coupling obstacle means is formed as a truncated disk.

6. A radio-frequency filter comprising:

an enclosure;

said enclosure having at least one wall surface;

first and second dielectric resonator means disposed within said enclosure in a spaced relationship;

said first and second dielectric resonator means defining therebetween an interstitial region;

each of said first and second dielectric resonator means having a center of mass;

said centers of mass defining a longitudinal axis extending therebetween;

at least one coupling obstacle means extending from said wall surface into said interstitial region;

said coupling obstacle means occluding less than half of the cross-sectional area within said enclosure as measured along a plane perpendicular to said longitudinal axis and with said plane intersecting at least a portion of said coupling obstacle means;

wherein said coupling obstacle means is a volumetric solid having at least first and second exterior edge contour sections, said first contour section having a shape matching that of said wall surface, said obstacle means being disposed within said enclosure such that said first contour section contacts said wall surface substantially over the entire extent of said first contour section, and said second contour section is substantially out of contact with any wall section.

7. The filter of claim 6 wherein said coupling obstacle means is formed as a substantially solid bar of conductive material.

8. The filter of claim 6 wherein said coupling obstacle means is formed as a thin conductive wire.

9. The filter of claim 6 wherein said coupling obstacle means is formed as a truncated disk.

10. A radio-frequency filter comprising:

an enclosure;

said enclosure having at least one wall surface;

first and second dielectric resonator means disposed within said enclosure in a spaced relationship;

said first and second dielectric resonator means defining therebetween an interstitial region within said enclosure;

each of said first add second dielectric resonator means having a center of mass;

said centers of mass defining a filter longitudinal axis extending therebetween;

and at least one coupling obstacle means extending from said wall surface into said interstitial region;

said coupling obstacle means being formed as a substantially solid elongate member having first and second longitudinally spaced ends;

said coupling obstacle means contacting wall surfaces of said enclosure substantially exclusively at said first and second ends;

wherein said coupling obstacle means has a longitudinal axis and said coupling obstacle means has means for adjusting the size of a cross-sectional area defined by the intersection of the exterior surface of the coupling obstacle with a plane parallel to said obstacle longitudinal axis and perpendicular to said filter longitudinal axis.

11. The filter of claim 10 wherein said elongate member has a rectangular cross section.

12. The filter of claim 10 wherein said elongate member has a non-circular cross section.

13. The filter of claim 12 wherein said elongate member has an elliptical cross section.

14. The filter of claim 10 wherein said elongate member has means permitting rotation of said coupling obstacle about its longitudinal axis.

15. The filter of claim 10 wherein said filter has means permitting rotation of said elongate member about an axis non-co-linear with its longitudinal axis.

16. The filter of claim 10 further comprising means for permitting adjustable displacement of said coupling obstacle through a range of positions along said longitudinal axis.

17. A radio-frequency filter comprising:

an enclosure;

said enclosure having at least one wall surface;

first and second dielectric resonator means disposed within said enclosure in a spaced relationship;

said first and second dielectric resonator means defining therebetween an interstitial region within said enclosure;

and at least one coupling obstacle means extending from said wall surface into said interstitial region;

said coupling obstacle means being formed as a volumetric solid having at least first and second exterior edge contour sections, said first contour section having a shape matching that of said wall surface, said obstacle means being disposed within said enclosure such that said first contour section contacts said wall surface substantially over the entire extent of said first contour section, and said second contour section is substantially out of contact with any wall section.

* * * * *